US008257047B2

(12) United States Patent
Mueller

(10) Patent No.: US 8,257,047 B2
(45) Date of Patent: Sep. 4, 2012

(54) ROTOR BLADE, METHOD FOR PRODUCING A ROTOR BLADE, AND COMPRESSOR WITH A ROTOR BLADE

(75) Inventor: Thomas Mueller, Fahrwangen (CH)

(73) Assignee: ALSTOM Technology Ltd., Baden (CH)

( * ) Notice: Subject to any disclaimer, the term of this patent is extended or adjusted under 35 U.S.C. 154(b) by 1010 days.

(21) Appl. No.: 12/240,029

(22) Filed: Sep. 29, 2008

(65) Prior Publication Data

US 2009/0087316 A1 Apr. 2, 2009

(30) Foreign Application Priority Data

Oct. 1, 2007 (CH) ..... 1527/07

(51) Int. Cl.
*F01D 5/30* (2006.01)

(52) U.S. Cl. ..... 416/219 R; 416/220 R; 416/224

(58) Field of Classification Search ..... 416/219, 416/220, 224, 219 R, 220 R, 222
See application file for complete search history.

(56) References Cited

U.S. PATENT DOCUMENTS

| | | | | |
|---|---|---|---|---|
| 2,857,132 | A * | 10/1958 | McDowall | 416/92 |
| 4,272,953 | A * | 6/1981 | Rice | 60/774 |
| 6,086,329 | A * | 7/2000 | Tomita et al. | 416/193 A |
| 2001/0019697 | A1 * | 9/2001 | Mueller et al. | 416/218 |

FOREIGN PATENT DOCUMENTS

| | | |
|---|---|---|
| DE | 318662 | 2/1920 |
| DE | 437049 | 11/1926 |
| DE | 1005530 | 4/1957 |
| DE | 4435268 | 4/1996 |
| DE | 102005048883 | 4/2007 |
| EP | 0551229 | 7/1993 |
| EP | 1698758 | 9/2006 |
| FR | 451147 | 4/1913 |
| JP | 59226202 | 12/1984 |
| JP | 2005220825 | 8/2005 |

OTHER PUBLICATIONS

English translation of Japanese Patent JP59226202 ( inventor Harada toshiyuki) date : Dec. 19, 1984.*
Search Report for Swiss Patent App. No. 1527/2007 (Feb. 4, 2008).
Search Report for European Patent App. No. 08165091.3 (Jan. 5, 2009).

* cited by examiner

*Primary Examiner* — Thinh T Nguyen
(74) *Attorney, Agent, or Firm* — Cermak Nakajima LLP; Adam J. Cermak

(57) ABSTRACT

A rotor blade for fastening on the rotor of a turbomachine, especially of a compressor of a gas turbine, has a blade airfoil and a blade root (15) which adjoins the lower end of the blade airfoil and extends along a blade axis and by which the rotor blade, in an encompassing slot which is arranged on the outer periphery of the rotor, is retained between two spacers (12, 18) which follow each other in the circumferential direction and which in their turn are retained in the slot. The blade root (15) is formed with a T-shape in cross section and includes circumferential shoulders (16, 16') which fit under the adjacent spacers (12, 18), and the spacers (12, 18), in the direction of the blade axis, engage by retaining surfaces (20) in undercuts (24) in the slot. Reduced production cost with comparable service life is achieved by the T-shaped blade root (15) being milled, and, for reducing the mechanical stresses at the transitions of the blade root (15) to the shoulders (16, 16'), by a relief groove (21), which extends in the direction of the blade axis.

12 Claims, 5 Drawing Sheets

Fig.4
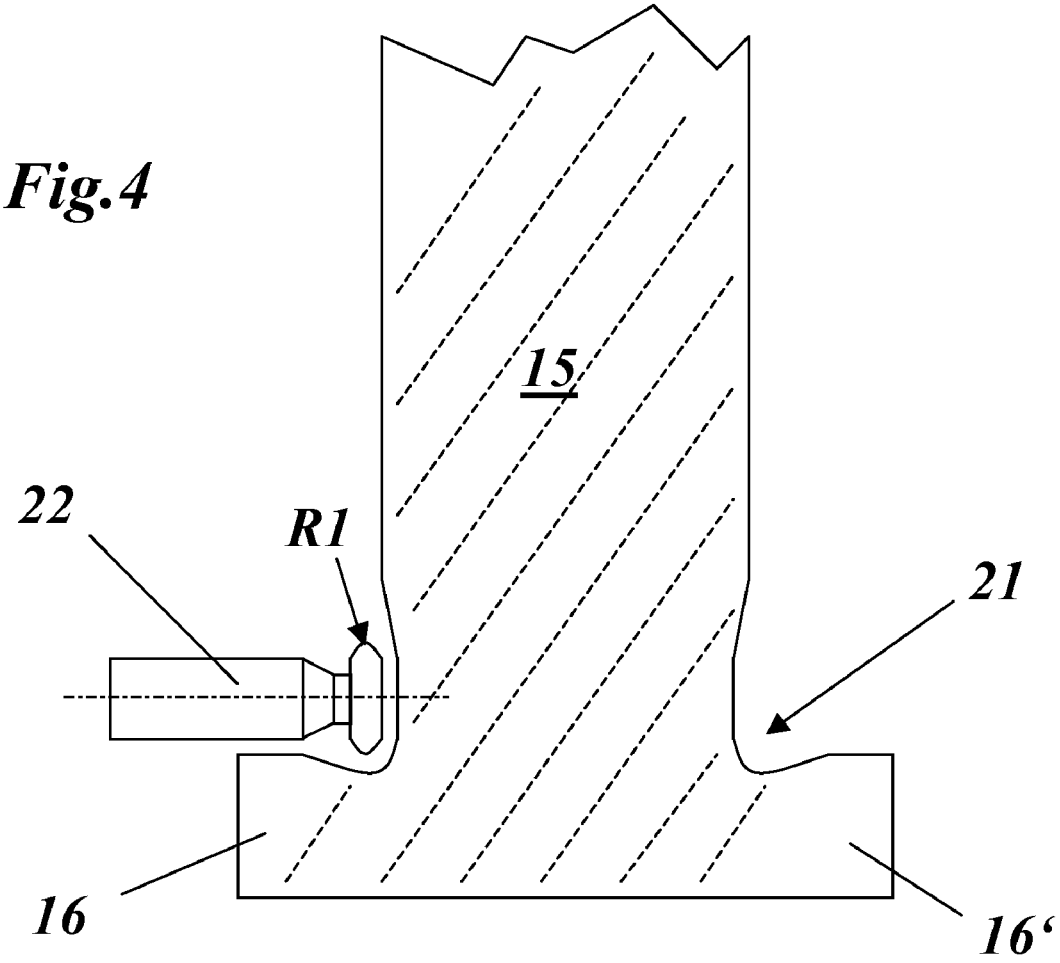
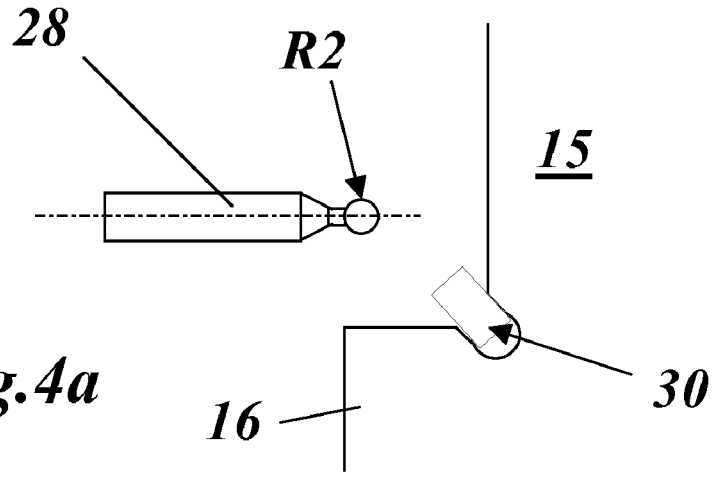
Fig.4a

ROTOR BLADE, METHOD FOR PRODUCING A ROTOR BLADE, AND COMPRESSOR WITH A ROTOR BLADE

This application claims priority under 35 U.S.C. §119 to Swiss application No. 01527/07, filed 1 Oct. 2007, the entirety of which is incorporated by reference herein.

BACKGROUND

1. Field of Endeavor

The present invention relates to the field of turbomachines. It relates to a rotor blade for fastening on the rotor of a turbomachine, to a method for producing a rotor blade, and also to a compressor with such a rotor blade.

2. Brief Description of the Related Art

The rotor blades of a compressor are part of an axial compressor system which moves and compresses large quantities of air which are required for the correct and reliable operation of a gas turbine system. The rotor blades are mounted on the outer periphery of the rotor of the compressor and are subjected to a large number of mechanical loads which especially also depend upon the type of blade fastening.

In order to reliably avoid the detachment of a rotor blade from the rotor, which is catastrophic for the system, various systems have been developed and proposed in the past for fastening the rotor blades on the rotor. One of these systems, to which the present invention relates, is the fastening system with a T-shaped blade root and spacers, as is reproduced in detail in a simplified form in FIGS. 1 and 2, and in FIG. 6, and which has been known for a long time for example from publication DE-PS-318 662.

In the case of this system, spacers 12, 18 are inserted one behind the other in the circumferential direction in a slot 11 which extends around the rotor axis (A2 in FIG. 5) of the rotor 10 and are retained in the slot 11 by retaining surfaces 20 which abut against undercuts 24. A rotor blade 13 or 27 is arranged in each case between two adjacent spacers 12, 18 and includes a blade airfoil 14, and by a T-shaped blade root 15 or 25 (see FIG. 6) which adjoins the blade airfoil 14 at the bottom and abuts against the side surfaces of the adjacent spacers 12, 18, and by shoulders 16, 16' or 26, 26' which project in the circumferential direction and fit under the adjacent spacers 12, 18. The spacers 12, 18 and the rotor blades 13 or 27 in this case are arranged at an angle to the rotor axis A2, so that the blade axis (A1 in FIG. 5) with the rotor axis A2 includes an angle of, for example, 25° (see FIG. 5).

The T-shaped blade roots 25 of the compressor rotor blades 27 have previously been formed (forged) by upset forging and so have obtained a grain structure which determines the strength, as is indicated in FIG. 6 by broken lines. In recent times, dependent upon new requirements with regard to costs, tools, and logistics, the changeover is increasingly being made to no longer forging the blade roots but producing the blade roots by milling (grain structure in FIG. 4). In order to achieve the same or an improved strength at the critical transitions to the shoulders 16, 16' or 26, 26' in the case of the milled blade roots, as in the case of the forged blade roots, a larger radius has to be provided at the transitions. In the case of the forged blade roots 25, the forged radius 29 lies approximately in the region of between 0.5 and 1.0 mm (FIG. 6). On account of the notch factor, milled blade roots require at the transitions a radius which is about 1.5 to 2 times larger than the forged radius 29.

The previous forging method for the blade roots 25 had further consequences: as a result of the upset forging, bulges 31 occur on the shank above the shoulders 26, 26' (in FIG. 6 this is indicated by the dotted lines) which lie within the range of 0.3 to 0.5 mm. So that the rotor blades installed with the forged blade roots 25, despite the side bulges 31, nevertheless abut securely and immovably against the adjacent spacers 12, 18, they are provided with a long chamfer 17, 19 on the side surfaces in the lower section, which creates the space for the bulges 31 (see also FIG. 3).

Although, depending upon the blade size, a 0.3 to 0.5 mm wide gap already exists between the adjacent spacers 12, 18 and the T-shaped blade root 25, an increase of the radius in the corners of the shoulders 26, 26' by the factor 1.5 to 2, as is required for milled blade roots, would cause an undesirable and hazardous collision exactly at the place where the relief of mechanical stresses actually should be the aim.

It is possible, on the other hand, to relieve mechanical stresses in the regions of machine parts in which, on the one hand, the risk of cracks is great, and on the other hand the space for the applying of larger radii, however, is limited, by providing suitably dimensioned and positioned relief grooves, according to ISO standard.

SUMMARY

One of numerous aspects of the present invention includes a rotor blade with a T-shaped blade root, of the type mentioned in the introduction, in a form so that it can be more favorably produced and yet achieves the service life which is customary for forged blade roots, and also to disclose a method for its production.

Another aspect of the present invention includes that the T-shaped blade root is milled, and that for reducing the mechanical stresses at the transitions of the blade root to the shoulders, a relief groove, which extends in the axial direction, is provided in each case. The compressor according to the invention has a rotor which is fitted with rotor blades according to the invention.

In principle, the relief groove can be a standard relief groove according to ISO standard. In particular, the relief groove is then a relief groove of type E or F according to DIN standard 509.

It is especially advantageous with regard to the reduction of the mechanical stresses if the spacers have a chamfer in each case on their side surfaces which are adjacent to the blade root, and if the relief groove has an increased height which deviates from a standard relief groove according to ISO standard and which exploits the chamfer. In this case, the height of the relief groove can especially correspond to approximately the height of the chamfer.

The relief groove preferably has a radius which corresponds to 1.5-2 times the radius of a comparable blade root which is formed by upset forging. In particular, the radius is 1.5 mm in the case of an upset radius of 0.8, or is 1.75 mm in the case of an upset radius of 1.0.

Furthermore, it is advantageous if the relief groove follows an elliptical curve shape in the direction of the blade axis.

A preferred development of the method according to the invention is characterized in that the relief grooves are milled along an elliptical machining path in the direction of the blade axis.

The machining becomes especially simple if a milling tool which deviates from the spherical shape is used for milling the relief grooves.

BRIEF DESCRIPTION OF THE DRAWINGS

The invention is to be subsequently explained in more detail based on exemplary embodiments in connection with the drawing. In the drawing

FIG. 4 shows the machining of the relief groove on the blade root with a larger milling tool according to an exemplary embodiment of the invention;

FIG. 4*a* shows the machining of the relief groove on the blade root with a smaller milling tool with spherical head;

FIG. 5 shows a blade root according to an exemplary embodiment of the invention in perspective view with an elliptical machining path drawn in.

DETAILED DESCRIPTION OF EXEMPLARY EMBODIMENTS

It is particularly advantageous for blades embodying principles of the present invention, that the increased radius which is required for the milled blade root is created by a relief groove which is preferably realized while taking into account the side chamfers which are formed on the spacers. As relief grooves, relief grooves according to ISO standard are first of all a possibility, which are constructed as relief grooves of type E and F according to DIN standard 509. In this case the relief groove of type E cuts only into one of the two adjacent surfaces which are perpendicular to each other, while the relief groove of type F cuts into both surfaces. The two relief groove types have special run-out regions (32, 33 in FIG. 3) which serve for the additional stress relief in the radius.

Figure 1:
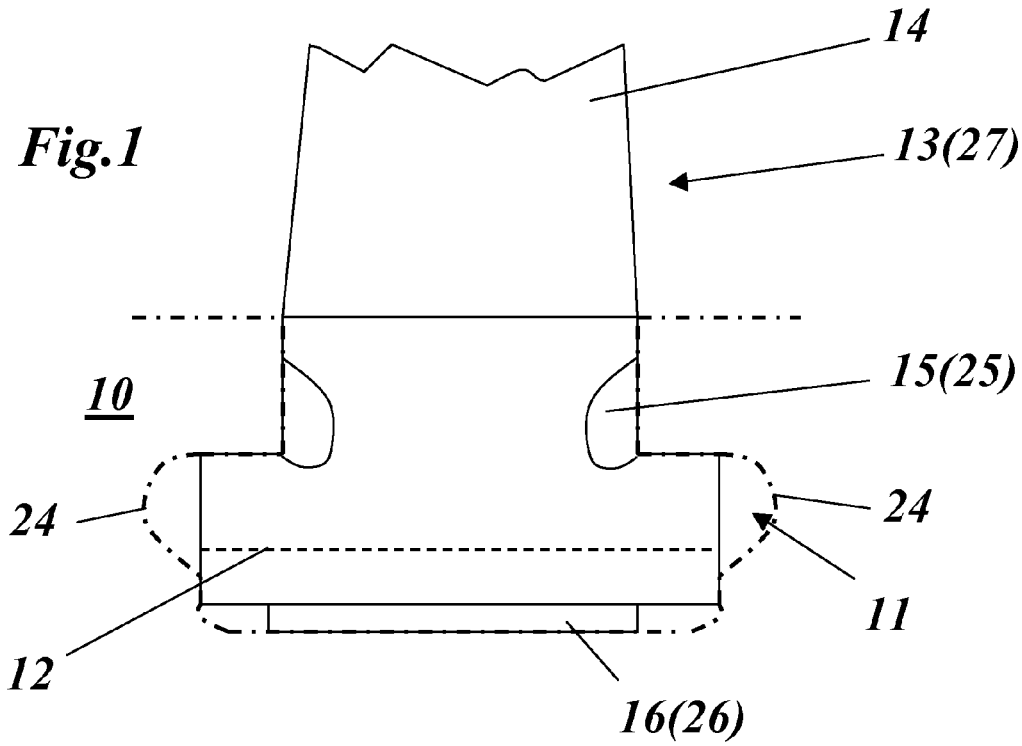
FIG. 1 shows the type of fastening of the rotor blades which forms the basis of the invention, with a T-shaped blade root between two spacers, as seen in the circumferential direction.
Figure 2:
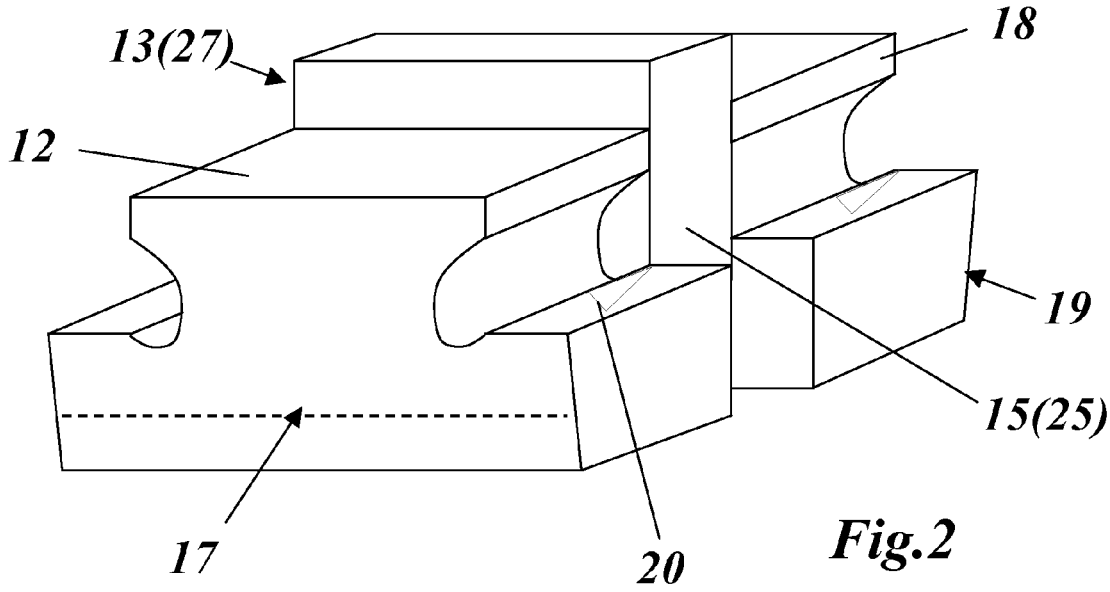
FIG. 2 shows the type of fastening of FIG. 1 in perspective view.
Figure 3:
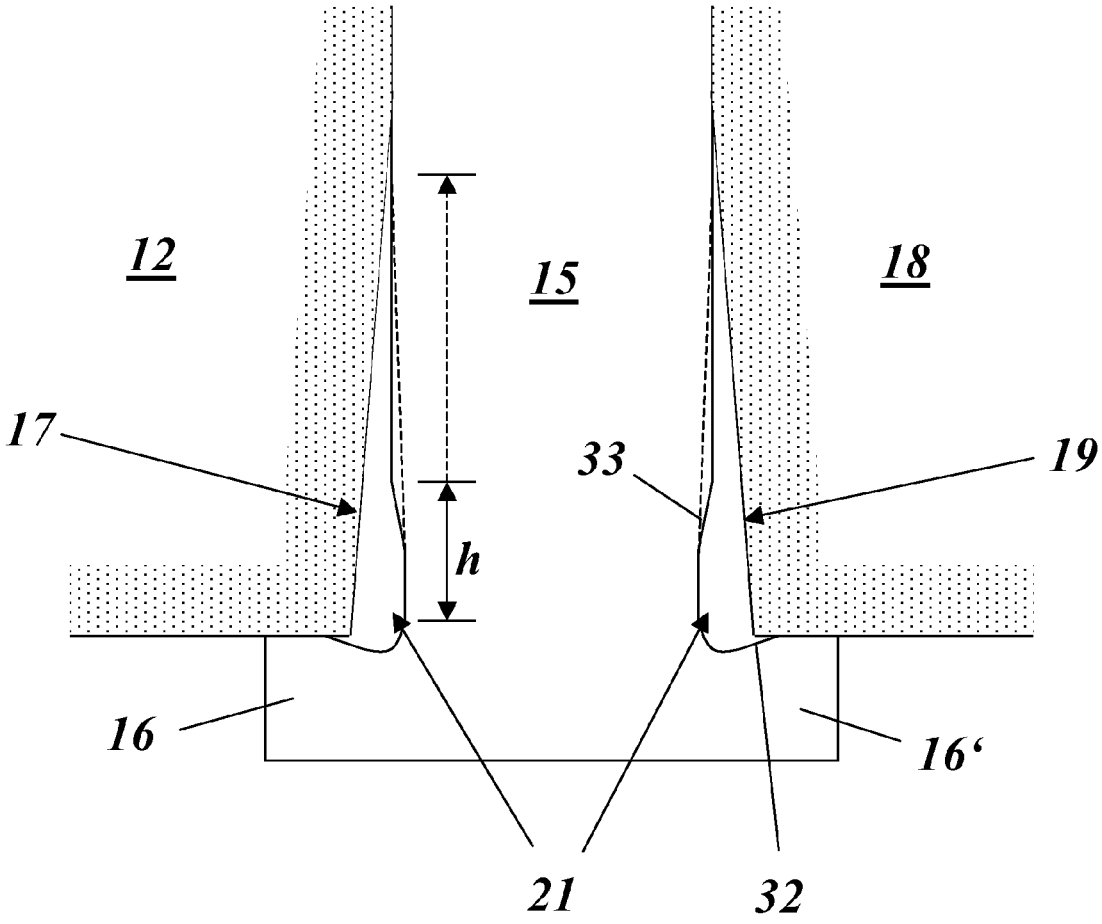
FIG. 3 shows the development of the blade root according to an exemplary embodiment of the invention.
Figure 6:
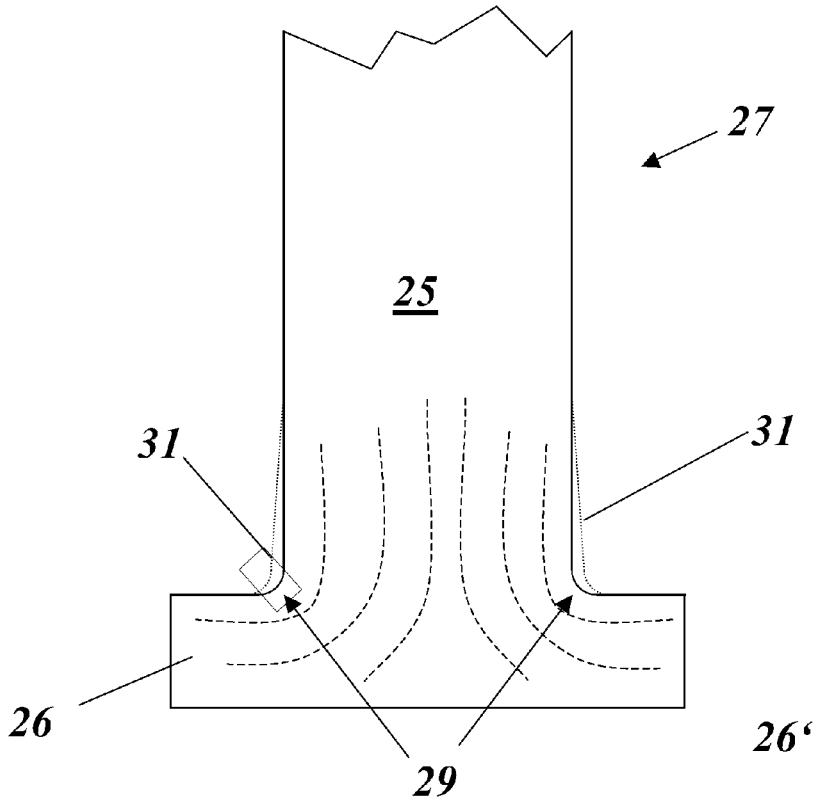
Fig.6 (Prior Art)
FIG. 6 shows the T-shaped blade root which is produced in a conventional manner by upset forging.

With such relief grooves, without the overall arrangement and type of fastening of the rotor blades being modified, the effect is achieved without any problem of the rotor blades with a forged blade root being able to be replaced by the more cost-effective rotor blades with a milled blade root without losses in the service life having to be suffered. In particular, the adjacent spacers 12, 18 do not have to be modified or additionally machined. The contact surface between the blade root (15 in FIG. 3) and the adjacent spacers 12 and 18 is delimited by the chamfers 17 and 19 on the side surfaces of the spacers 12, 18, but is also defined so that the type of relief groove 21 within the region of the chamfers 17, 19 does not have any influence on the contact surface (FIG. 3). Accordingly, the rotor blades are always retained in the same manner between the spacers 12, 18, regardless of whether the blade root is forged (FIG. 6) or milled (FIG. 4). From this it also follows that the natural frequencies (resonances) of the blades do not change so that a complete exchangeability between the differently produced blades exists.

A standard relief groove of type F, as already mentioned above, cuts into the two adjacent perpendicular surfaces in the corners of the shoulders 16, 16' of the blade root 15 (FIG. 4*a*). This is an advantageous way to achieve the enlarged radius for the desired same or longer service life compared with forged blade roots. Such a standard F relief groove, however, can only be created by a milling process if at the same time the relief groove is to be effected along an elliptical machining path (23 in FIG. 5) in the direction of the blade axis A1. The relief groove, however, is to be milled only with very high cost since the small milling tool 28, which is shown in FIG. 4*a*, with a spherical milling head (head diameter (2×radius R2): 2-3 mm; shank diameter: 1.5-2 mm) has to be used for this.

Figure 5:
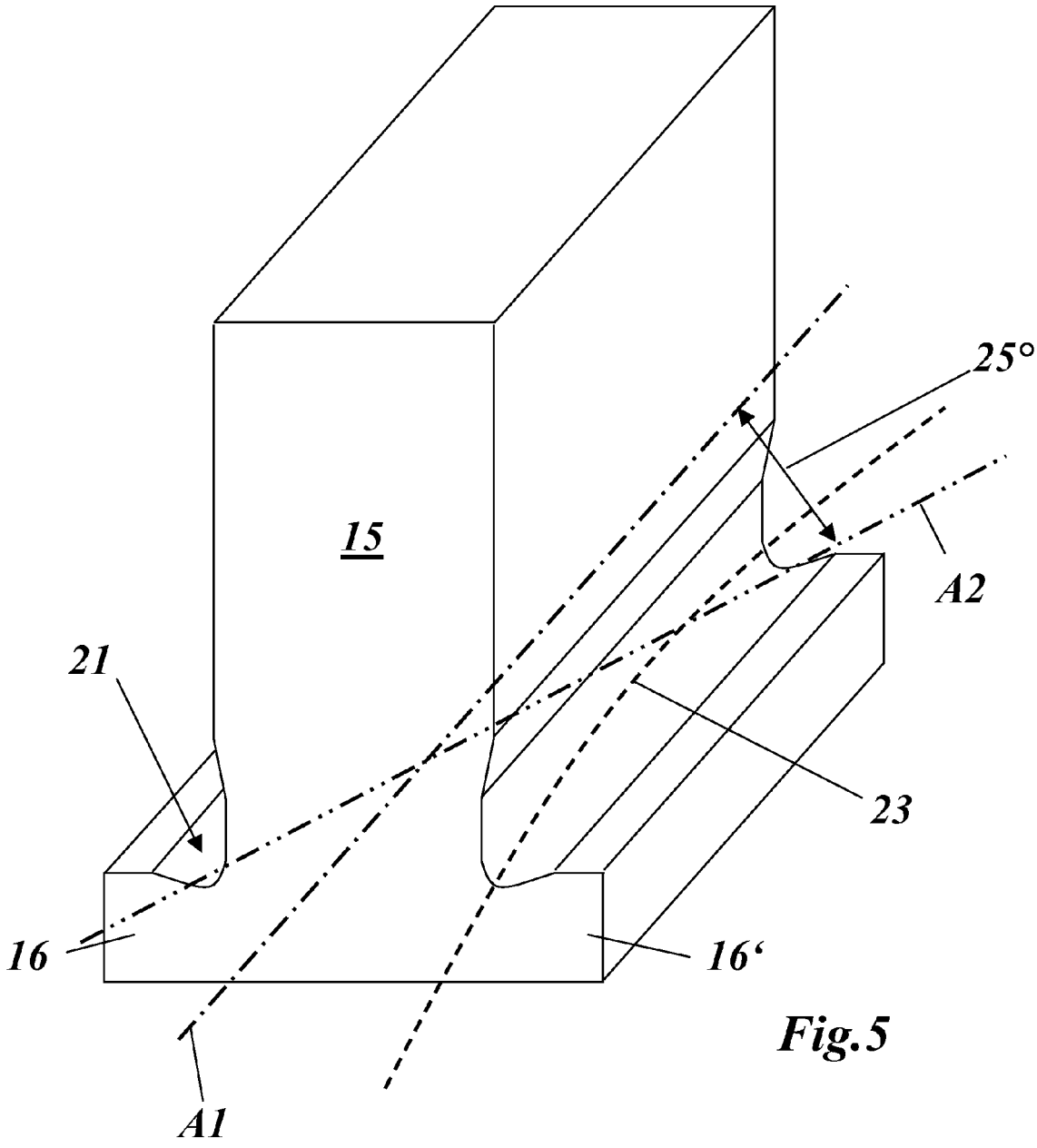

Therefore, in the case of the blade root 15, the modified relief groove 21 which is shown in FIGS. 3, 4, and 5 is preferably used, which is characterized by an increased height h in the direction of the longitudinal axis of the blade. In particular, the height h of the relief groove 21 corresponds to the entire length of the chamfer 17, 19 on the side surfaces of the spacers 12, 18. The increase of the height h compared with the standard relief groove 30 makes it possible to use a larger milling tool 22, according to FIG. 4, with a radius R1>R2 (R1 is for example 1.75 mm), as a result of which the costs and the machining times are significantly reduced (the broken line hatching in FIG. 4 indicates that the blade root 15 is milled and not forged).

The described increase of the height h of the relief groove is not only allowed (because as a result of the long chamfer 17, 19 there is no contact anyway between blade root 15 and the spacers 12, 18), but is also desired because the stresses in the notch are automatically reduced as a result.

LIST OF DESIGNATIONS

| | |
|---|---|
| 10 | Rotor |
| 11 | Slot |
| 12, 18 | Spacer |
| 13, 27 | Rotor blade |
| 14 | Blade airfoil |
| 15, 25 | Blade root |
| 16, 16' | Shoulder |
| 17, 19 | Chamfer |
| 20 | Retaining surface |
| 21, 30 | Relief groove |
| 22, 28 | Milling tool |
| 23 | Elliptical machining path |
| 24 | Undercut |
| 26, 26' | Shoulder |
| 29 | Forging radius |
| 31 | Bulge |
| 32, 33 | Run-out region |
| A1 | Blade axis |
| A2 | Rotor axis |
| h | Height (relief groove) |
| R1, R2 | Radius (relief groove) |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A rotor blade fittable on the rotor of a turbomachine, the rotor having a circumferential slot in an outer periphery of the rotor, the slot including undercuts, the slot including circumferentially adjacent spacers having retaining surfaces which, in the direction of a blade axis, are engageable with surfaces in the slot undercuts, the rotor blade comprising:

a blade airfoil having a lower end;

a blade root, adjoining the lower end of the blade airfoil and extending along a blade axis, retainable between two of the spacers, wherein the blade root includes a T-shape cross section and circumferentially extending shoulders, the shoulders configured and arranged to fit under adjacent spacers, wherein the T-shaped blade root is formed by milling; and a relief groove at transitions of the blade root to the shoulders extending in the direction of the blade axis, for reducing mechanical stresses.

2. The rotor blade as claimed in claim 1, wherein the relief groove is a standard relief groove according to ISO standard.

3. The rotor blade as claimed in claim 2, wherein the relief groove is a relief groove of type E or F according to DIN standard 509.

4. The rotor blade as claimed in claim 1, wherein the spacers each have a chamfer on side surfaces which are adjacent to the blade root, and wherein the relief groove has a height greater than a standard relief groove according to ISO standard.

5. The rotor blade as claimed in claim 4, wherein the height of the relief groove is approximately the same as the height of the chamfer.

6. The rotor blade as claimed in claim 4, wherein the relief groove has a radius R1 which is 1.5-2 times greater than the radius of a comparable blade root when formed by upset forging.

7. The rotor blade as claimed in claim 1, wherein the relief groove follows an elliptical curve shape in the direction of the blade axis.

8. A method for producing a rotor blade as claimed in claim 1, the method comprising:

milling said T-shape of the blade root; and thereafter milling said relief grooves into the blade root.

9. The method as claimed in claim 8, wherein milling the relief grooves comprises milling along an elliptical machining path in the direction of the blade axis.

10. The method as claimed in claim 8, wherein milling the relief grooves comprises milling with a non-spherical milling tool.

11. A compressor useful with a gas turbine, the compressor comprising:

a rotor having a circumferential slot in an outer periphery of the rotor, the slot including undercuts;

circumferentially adjacent spacers in the slot, the spacers having retaining surfaces which, in the direction of a blade axis, are engageable with surfaces in the slot undercuts; and rotor blades as claimed in claim 1 fitted to the rotor in the slot.

12. A turbo set comprising:

a gas turbine; and a compressor according to claim 11.

* * * * *